US006367764B1

(12) United States Patent
Butler

(10) Patent No.: US 6,367,764 B1
(45) Date of Patent: Apr. 9, 2002

(54) VERSATILE THREADED CONSTRUCTION STAKE USABLE TO ANCHOR AND/OR SUPPORT CONSTRUCTION FORMS, INCLUDING CONCRETE SLAB FOUNDATION FORMING DEVICES

(76) Inventor: Michael G. Butler, 31078 Turner Rd., Fort Bragg, CA (US) 95437

( * ) Notice: Subject to any disclaimer, the term of this patent is extended or adjusted under 35 U.S.C. 154(b) by 0 days.

(21) Appl. No.: 09/185,336

(22) Filed: Nov. 3, 1998

Related U.S. Application Data

(63) Continuation-in-part of application No. 08/600,408, filed on Feb. 12, 1996, now Pat. No. 5,830,378, which is a continuation-in-part of application No. 08/398,356, filed on Mar. 3, 1995, now abandoned, which is a continuation-in-part of application No. 08/299,474, filed on Aug. 29, 1994, now Pat. No. 5,264,235.

(60) Provisional application No. 60/013,589, filed on Mar. 15, 1996.

(51) Int. Cl.[7] ..... E02D 20/00; E04G 11/00

(52) U.S. Cl. ..... 249/3; 249/7; 249/18; 405/259.1; 411/397

(58) Field of Search ..... 405/259.1, 259.2, 405/259.3, 259.4; 411/397, 396, 222, 3, 8, 429; 249/3–7, 13, 18, 210

(56) References Cited

U.S. PATENT DOCUMENTS

| | | | | | |
|---|---|---|---|---|---|
| 1,975,815 | A | * | 10/1934 | Wilson | 411/222 |
| 2,835,017 | A | * | 5/1958 | Hoerr | 249/3 X |
| 3,378,968 | A | * | 4/1968 | Shoemaker | 249/6 X |
| 3,810,364 | A | * | 5/1974 | Johnson | 405/154 |
| 3,903,626 | A | * | 9/1975 | Ford | 411/340 X |
| 4,258,514 | A | * | 3/1981 | St. Clair | 52/86 |
| 4,340,200 | A | * | 7/1982 | Stegmeier | 249/3 |
| 4,536,115 | A | * | 8/1985 | Helderman | 411/397 X |
| 4,618,291 | A | * | 10/1986 | Wright | 411/3 X |
| 4,630,971 | A | * | 12/1986 | Herbst et al. | 405/259.1 X |
| 4,699,547 | A | * | 10/1987 | Seegmiller | 405/259.1 X |
| 5,154,560 | A | * | 10/1992 | Copito | 411/222 X |
| 5,366,328 | A | * | 11/1994 | Helderman | 411/17 |
| 5,564,235 | A | * | 10/1996 | Butler | 249/4 X |
| 5,817,247 | A | * | 10/1998 | Colatruglio | 249/4 |
| 5,830,378 | A | * | 11/1998 | Butler | 249/18 |
| 5,873,689 | A | * | 2/1999 | Mensour et al. | 411/3 |

* cited by examiner

*Primary Examiner*—David Bagnell
*Assistant Examiner*—Jong-Suk Lee
(74) *Attorney, Agent, or Firm*—Fuess & Davidenas

(57) ABSTRACT

A stake suitable for use in construction is formed from an elongate threaded metal member, typically of length between 0.45 meter and 1.8 meter, having two ends. A first end region, tapered to a sharp point over typically 3 centimeters, is suitable to be plunged into earth. A middle region has threads that are both deeply cut, typically at a ratio of root diameter to outside diameter less than 0.80, and steeply inclined, typically at least 1 in 20. A second end region has a feature in the shape of a regular prism suitable to be engaged by a torquing tool for rotation of the entire stake. The second end region feature may be a prism of regular cross section, normally a hexagonal prism, of a diameter everywhere less than the minor diameter of the middle region's threads. The second end region feature is preferably (i) a continuation of the middle region's threads in combination with (ii) several, normally two, nuts of 9 mm nominal internal diameter threaded onto the feature and tightly jammed together. The stake is readily screwed into and extracted even from even hard earth by forcible rotation with power tools. The threaded stake readily mounts devices and fixtures, and is particularly useful as part of an assemblage for forming monolithic concrete slab-on-grade foundations in situ.

8 Claims, 3 Drawing Sheets

VERSATILE THREADED CONSTRUCTION STAKE USABLE TO ANCHOR AND/OR SUPPORT CONSTRUCTION FORMS, INCLUDING CONCRETE SLAB FOUNDATION FORMING DEVICES

REFERENCE TO RELATED PATENT APPLICATIONS

This application is a CIP of Ser. No. 08/600,408 filed Feb. 12, 1996 now U.S. Pat. No. 5,830,378 which is a CIP of Ser. No. 08/398,356 filed Mar. 3, 1995 abn which is a CIP of Ser. No. 08/299,474 now U.S. Pat. No. 5,564,235 Provisional Application No. 60/013,589 filed Mar. 15, 1996.

BACKGROUND OF THE INVENTION

1. Field of the Invention

The present invention generally concerns improvements to stakes used in construction to temporarily hold things, such as construction forms, in position upon the surface of the earth. The stakes of the present invention will be seen to be particularly, although not exclusively, useful in the practice of a patented method of constructing a monolithic in-situ concrete slab foundation and in related concrete work.

The construction stakes of the present invention are particularly useful as part of a construction form system, and in a method of making a slab on grade foundation.

2. Description of the Prior Art

While much prior art can be found in the field of slab foundations and related concrete work, the commercial success of contemporary proprietary systems which form a concrete-slab-on grade is limited. The primary reasons for this are that the proprietary systems tend to be expensive, contrived, and inflexible. Furthermore, forming a concrete slab on a prepared building pad is not a significant engineering feat, and so is generally endeavored with simple boards and stakes.

The board and stake concept offers design flexibility, but it does have significant drawbacks. These drawbacks include: wasted labor to define and check geometry, poor accuracy of surfaces and embedded hardware, difficulty in adjusting form locations after stakes are set, and inconsistent repeatability for multiple units. Back injury, caused by pulling a conventional stake out of the ground, is a common complaint in the foundation business. Poor foundation accuracy is always a concern, and it has a more consequential negative affect on the framing process for a structure of light gage metal members. This is because the framing assemblages of these members tolerate little dimensional error at the points of support.

Established proprietary concrete forming systems include such ones as 'Metaform', which are of folded sheet metal. Lengths are generally in 10' increments, which is the length of the brake that folds the sheet metal. For a long run of perimeter form this results in frequent potential segmental kinks. Conforming to custom dimension and design requires the cutting up of relatively expensive lengths of form. Stakes must be placed only at specific holder locations provided on the forms, and no subsequent relative horizontal adjustment is possible. If a rock or obstruction happens to be at one of these specific locations, then one must compromise either form location or stake support.

Solutions addressing the need to adjust forms relative to stakes include the system disclosed in Canadian patent 1,145,179 by Breitenbach, issued Apr. 26, 1983. This apparatus allows adjustment of form location subsequent to setting of stakes, by a system of supporting yokes consisting of bars, sleeves, and brackets. This type of a solution involves one or a pair of sets of moving parts for each direction of adjustment. Each supporting assemblage is subject to unwanted lateral movement due to the fact that the each of the supporting stake pairs are required to be essentially parallel for vertical adjustment of the yoke, which attaches to them above the forms. Stakes in loose soils simply do not hold up to this kind of side cantilever loading. Even bending of the stakes can be enough of a problem, given the relatively high point of attachment. Each of these assemblages is heavy, clumsy, relatively expensive, and an obstruction to the concrete work, especially for slab-on-grade foundations. There are too many parts to buy, clean, and maintain.

A somewhat simpler proprietary forming method offers subsequent adjustment in the vertical direction only. This is disclosed in U.S. Pat. No. 3,397,494, Waring, issued Aug. 20, 1968. With this system, vertical support to a proprietary perimeter member is provided with rods having machine thread. These rods thread into bearing pads that sit upon the earth, and then support the special cast in place perimeter member directly. No allowance is provided for rod location. It must be directly at a hole in the member, regardless of what local anomaly or rock may be at the ground below that point. The rod supports offer little resistance to uplift from the buoyant forces of concrete placement, because they do not have threads capable of threading into earth, and so are not used in that manner. This support offers essentially no lateral force resistance. In fact, the system requires a redundant conventional perimeter form board with conventional stakes, et cetera, for structural stability. The main purpose of the present invention is to provide placement of a cast in-situ foundation perimeter for a proprietary wall system which requires a special recessed ledge.

For slab-on-grade foundations, most contractors prefer to continue to form with simple boards and stakes, in spite of the drawbacks, because they do not impose a lot of contrivance, have a low initial cost, and provide flexibility in geometry. Those in the trades have grown to accept the challenges of building foundations with a most primitive technology. It is generally understood that foundation construction includes performing redundant efforts at determining geometry, having a difficult time making geometrical adjustments, and then getting complaints about accuracy from the people building the structure atop anyway. In truth, all of these problems really can be solved without forcing a lot of limitations and contraptions upon the foundation builder, as the following discussion will illustrate.

The objects and advantages of the present invention will shortly be seen to bee as follows.

In order to evaluate a new foundation construction practice, it is sensible to first examine some contemporary needs of the industry.

Tract home builders most often build slab-on-grade foundations. Normally, a building pad is created for each unit. This pad is typically graded so as to completely facilitate slab-on-grade foundation construction. Identical unit footprints, and mirrored versions, are repeated often. The foundation forming method should effectively address this circumstance.

Homes built today tend to have more seismic hardware anchored in the foundation than earlier homes did. Increasingly, post-tension slab-on-grade foundations are being built in order to achieve economy at sites having expansive soil conditions. All of the post-tension anchors must be located correctly along the perimeter form, and in conjunction with the conventional hardware embedments. In general, more connections located in a tighter space demands more accuracy of the foundation forming method which locates these items. Additionally, the task of physically locating an element of hardware is performed very often. So, the task must be made to be as easy and repeatable as possible.

A growing number homes are being framed with members of cold-formed light-gage steel. The framing of these homes requires greater accuracy than most foundation contractors will deliver, particularly for the cost effective 'panelized' structures (the metal stud walls are framed in a shop and erected at site). For the increasingly common 'panelized' structure, a very accurate foundation, to the last hardware embedment, is required for cost effective construction. For repeat units of 'panelized' homes, the accuracy must be such that entire buildings and foundations be considered as interchangeable parts, if true production building is to occur.

An important component of foundation accuracy is easy adjustment of location of foundation forms, so that needed adjustments are made rather than ignored. For custom built structures, provision for easy adjustment of foundation forms is significant. This is because, compared to repetitive construction, relatively far more labor tends to be expended on the custom geometry definition. So, the ability to have adjustment after forms are initially set up, provides a big labor savings for even one unit. It is best if all the foundation form support locations can be adjusted simultaneously. This way an entire lightweight forming unit, which is internally collocating, can be assembled whole, floating on supports, before being committed to the exact permanent placement.

Most contemporary post-tension slab-on-grade foundation construction is built on a flat-graded earth pad without trenches. This increasingly popular method requires no lay out of trenches, so a foundation forming method which does not require the lay out of any geometry at all, can provide significant labor-saving benefit to the foundation construction process.

The present invention provides the fastest means possible of constructing a concrete slab foundation. The process is more convenient and less injurious than conventional methods. The investment is less and the utility more diverse than with other proprietary methods. The results are more reliable and accurate. Components of the present invention offer novel utility independently, and with elements of co-pending patent applications, they offer substantial benefit for other types of foundations.

The present invention utilizes the increasingly available light-gage roll-formed steel members as concrete forms. They are low cost, light-weight, and are supplied in any desired lengths. These standardized "C" shaped sections are supported by exceptionally simple components which allow subsequent adjustment of forms relative to stakes, in all three orthogonal directions.

Other elements of the present invention combine with the form members to create a collocating-upon-assembly forming unit for an entire slab foundation. This forming unit may be assembled while floating on supports, and then adjusted into place. It can be built to be light-weight enough to allow a crew to carry it whole from unit to unit, as if it were a large cookie cutter.

With the present invention, adjustments to form locations are facilitated by the use of coarsely threaded rods which offer support directly. This is because the same adjustment rods which connect to form components, also thread directly into the earth. Threading into earth improves resistance to buoyant forces from concrete placement, and thus facilitates use of light-weight forms. The threaded stakes may also be angled outward so as to buttress the forms directly. They are much easier to get into and back out of the ground than conventional stakes are. Threaded stakes offer significant improvements to the construction of most any type of in-situ concrete foundation.

The present invention requires less labor than any other method to build a concrete slab foundation. It will please any builder with the inherent, repeatable accuracy. Elements of the present invention provide labor-saving and quality-enhancing utility for most kinds of foundations.

SUMMARY OF THE INVENTION

The present invention contemplates a reusable steel threaded stakes that are (i) easily driven into, and easily extracted from, even hard earth by use of lever tools including power tools, and, once situated, are (ii) versatile to interact with each other, to align things such as construction forms and, uncommonly, in combination to support a construction form level and true above the surface of the earth.

The threaded construction stakes of the present invention, although well suited and superior for general use in construction, are particularly efficacious of use with the construction form system, and method, for easily and efficiently making a slab on grade foundation upon the surface of the earth that is the subject of the related predecessor U.S. Pat. No. 5,830,378. In the system and method of that invention the construction stakes support a fast and easy, repetitive, setup of a construction form supported level and true above the surface of the earth. The stakes are interactive with a quick-acting device for connecting and holding the construction form to the stakes precisely and accurately at any arbitrary position.

1. A Preferred Embodiment of a Stake for Use in Construction

The present invention is embodied in a stake generally suitable for use in construction of buildings upon the face of the earth. The preferred embodiment of a construction stake of the present invention consists of an elongate threaded metal member having (i) a length between 0.45 meter and 1.8 meter, (ii) a tapered (pointed) first end region that is suitable to penetrate the earth under force of screwing the member into the earth, and (iii) a second end region in the shape of a regular prism.

The prism-shaped second end region is suitable to be engaged and to be rotated, turning the entire elongate threaded member by a rotating tool which may be manual but which is most commonly a power tool, normally of the pneumatic impact wrench or electric drill type. Particularly by use of a power torquing tool the threaded stakes may be easily driven and strongly set into even the hardest earth. (The stakes are not for use in solid rock, but may easily bypass such rocks as are commonly found even in rocky soils.)

In one, less preferred, embodiment the second end region has a maximum diameter that is everywhere effectively less than a root diameter of the externally threaded middle region. The second end region typically has a hexagonal cross section, and is engagable by a standard socket of a torquing tool for screwing the member into, and out of, the earth.

In its preferred embodiment the second end region is comprised of two nuts that (i) thread the elongate threaded member, the treads of which are continued all the way to the rod's second end, and (ii) are subsequently jammed together at any convenient displacement within the second end region from the second end, at which time neither nut will turn unless forcibly disengaged from the other. In accordance that the threads to the rod body, next discussed, preferably have a particular form—coil threads—and are thus preferably of a high pitch, the two nuts are most commonly not everyday common machine nuts. Their principle of operation is, however, the same as any nut. Each nut threads quite easily upon even a dirty or corroded rod, including by simple force of the hand and fingers, until, at the desired position, the end-most is modestly jammed, or locked, against an inner nut. At this time a torquing tool mounting a deep wall socket is fit around the upper nut only, and, the inner nut not turning, will suffice to rotate the rod, threading it into the earth. The nuts normally become jammed, or locked, together so tightly that the rod may later be unscrewed from the earth by reverse torque as is applied to the outer nut only. A heavy wrench, or even a pipe wrench, may alternatively be used to engage either nut both so as to turn the rod in one direction so as to screw it into the earth, or in the other direction so as to unscrew it from the earth. However, if the nuts work apart, then the torque to unscrew the rod from the earth may be applied to the inner nut by a wrench. The nuts can of course be separated by the simple expedient of torquing each in an opposite direction, normally by use of two wrenches, or one wrench and the power torquing tool.

The thread of the middle region is preferably both (i) deeply cut, having at a ratio of root diameter to outside diameter of typically less than 0.80, and (ii) steeply inclined, the threads having an incline of about 1 in 9.4. The steepest incline that will permit the nuts to remain tight is optimal for driving the stakes into dirt, and incline is preferably at least 1 in 20. If the less preferred embodiment of the second end region in the shape of a prism of diameter everywhere effectively less than the root diameter of the externally threaded middle region is employed, then a threaded nut may be passed over the second end region in order to threadingly engage the middle region. In other words, nuts can be used with and on the central region of the rod member—which is always threaded—regardless that the second end region of the rod should, in a less preferred embodiment, not be threaded.

The stake is preferably made from a 0.6 meter to 1.8 meter (two foot to six foot) length of steel rod having a low root-to-major-diameter ratio, normally less than 0.5. Standard steel coil rod having an approximate diameter of 12 millimeters and approximately 6 threads each 25.4 millimeters is most suitable. The stake's first end region is preferably tapered to a point over at least 1.9 centimeters (¾ inches) of length.

In the preferred embodiment, the stake has an upper end enabling a torsional force to be applied via a pair of mutually locked hex nuts, in lieu of a prismatically shaped end. With this configuration, the top of the stake is a simple cut end, which can be de-burred as required. In this embodiment the stake has and presents steeply inclined threads not only in its entire middle region between the first and the second end regions, but also contiguously from the middle region through the second end region all the way to the second end.

In a less preferred embodiment the second end, top, region of the stake is preferably formed to a regular prism over at least 1.3 centimeters (½ inch) of length. In this case the threads at the other, first, end region of the stake, and in the middle region, need only extend so far as the stake is likely to be driven into the ground. Normally, however, for ease of manufacture the threads extend the full length of the stake all the way to the prismatic second end, top, region.

If the second end region in the shape of the regular prism, preferably the hexagonal prism, then it is preferably so formed by milling over at least 2.54 centimeters (1 inch) of length. The head may alternatively be formed by forging, again preferably in the shape of a regular prism. The head in the shape of a regular prism facilitates that a rotating tool engaging this second end head region may impart considerable torque to rotating the stake without damage to, or excessive wearing of, the stake.

Of course, the same is true of the preferred second end region jammed nuts. If, due to excessive torque, one or both of these nuts becomes worn or even split, substA Construction Form System The threaded stakes of the present invention are particularly efficacious of use in construction form system. The construction form system is based on a form that is capable of being assembled, aligned, trued and thereafter moved intact over and upon the earth. The construction form has and presents (i) a substantially planar face to its interior and (ii) a substantially contiguous peripheral "C"-channel to its exterior.

In accordance with a related invention, a collocating sub-system is used to conveniently, easily, quickly, accurately and precisely spatially locate and hold this construction form above the earth. The sub-system is based on several cooperatively interactive parts.

A number of bent-planar-elements twist slightly about an imaginary horizontal axis so as to engage and hold the construction form at its peripheral exterior "C" channel. These bent-planar-elements are preferably in the substantial form of bent plane having (i) a length, and (ii) a cross section, orthogonal to an axis of the length, that is topologically equivalent to a "U" with a substantially central trough and two flanges. Each of the two flanges has at its furthest extent a feature that is complimentary to fit within, and to engage, the "C"-channel of the construction form. When so engaged the bent-planar-element extend across the width of the "C"-channel, and across the width of the construction form of which the "C"-channel is a part.

A large number of elongate metal stakes of the present invention—tapered (typically to a sharp point) on one end while presenting a feature for coupling rotational forces on the other end while threaded in the middle—are conveniently located—normally by being screwed into the earth by hand-held power torque wrench—at the external periphery of the sited construction form. A first group of the stakes are each so screwed into the earth roughly vertically through an aperture formed by the "U" cross-section of a bent planar element and the exterior of the construction form engaged (at its "C" channel) by this bent planar element. Meanwhile, preferably yet another, second, group of the stakes are screwed into the earth at an incline so as to approximately intersect the approximately vertical first group of stakes at spatial regions above the earth, and above the bent planar elements. The stakes are typically cut and formed in 0.6 meter to 1.8 meter lengths from steel coil rod.

A number of first assemblies both slip and thread the substantially vertical stakes of the first group so as to ultimately be held by threaded engagement with these stakes at selected heights that are suitable to collocate and to hold the bent planar elements, and thus also the construction form that the bent planar elements engage, level above the earth. These first assemblies preferably consist of a number of nuts and open-channeled "hairpin" bars. The nuts either slide over, or thread, the top of the featured end regions of the first group of stakes, and thread a threaded middle region of the stakes. The open-channeled "hairpin" bars slip over and along the stakes until coming to rest against a nut. The bars serve to increase the effective external diameter of the nut.

Because the bent-planar-elements are, as previously stated, preferably in the substantial form of bent plane having (i) a length, and (ii) a cross section, orthogonal to an axis of the length, that is topologically equivalent to a "U" with a substantially central trough and two flanges, each of the two flanges serves, in conjunction with the engaged "C"-channel of the construction form, to present an aperture. A vertical stake of the first group is passed through this aperture and is threaded into the earth. Each of the bent-planar-elements is stopped and held by an associated one of the first assemblies, each at a position determined by this first assembly and its associated stake.

By this arrangement of parts, a vertical stakes is passed through a trough of a bent-planar-element. The bent-planar-element is subsequently stopped to the stake by the open-channeled bar and the nut. Thus stopped the bent-planar element serves to engage, and to hold, the foundation form at a localized region. The collective bent-planar elements, first assemblies and vertical stakes thus serve to support the foundation form level above the earth.

Remaining sub-system parts serve to accurately precisely adjust the supported foundation in direction (i.e., in angle of rotation in the level plane). A number of second assemblies slip and thread both the substantially vertical stakes and the associated inclined stakes so as to ultimately be held to, and between, these stakes by threaded engagement with both. These second assemblies are adjustable so as to move the upwards extension of the vertical stakes relative to the inclined stakes, and relative to the earth, so that the level construction form is adjusted in direction. Notably, the level support of the construction form above the earth by and on the bent-planar-elements, the first assemblies, and the vertical stakes both accommodates and permits this adjustment.

Opposite corners of the construction form may be connected with and by adjustable squaring wires in order to promote correct and square location of the sides of the construction form.

Accordingly, the construction form is conveniently, easily, quickly, accurately, and precisely spatially located and held above the earth. When a pourable construction material is poured into the construction form a slab on grade foundation is created. Each of the construction form, the vertical and inclined stakes, the bent-planar-elements, and the first and second assemblies may all be removed from the foundation of hardened pourable construction material, re-sited, and reused.

3. A Method of Making a Slab on Grade Foundation

The threaded construction stakes of the present invention support the method of making a slab on grade foundation that is the subject of U.S. Pat. No. 5,830,378.

In the preferred method a foundation form is first assembled upon the surface of the earth. The form engages at and around its periphery a number of "U"-shaped bent-planar members, the "U" of the member and the exterior surface of the form jointly creating and presenting a vertically oriented elongate aperture.

A number of first threaded stakes in accordance with the present invention are then screwed substantially vertically into the earth though the vertically oriented elongate apertures as are situated periodically at convenient intervals around a periphery of the foundation form. Meanwhile, a number of second threaded stakes in accordance with the present invention are screwed into the earth so as to proximately spatially intersect the first threaded stakes at regions above the earth.

A first assembly is adjustably located upon each first threaded, substantially-vertical, stake by, ultimately, a threaded affixation to the threads of the stake. Each first assembly serves to support a corresponding "U"-shaped bent-planar member, and through this corresponding member, the construction form, upon a first threaded stake. Each first assembly and associated bent planar member are thus used to temporarily locally join a first stake to the external circumference of the foundation form. The collective "U"-shaped bent-planar members and first assemblies collectively temporarily join the entire foundation form to the first stakes, temporarily supporting the foundation form level above the surface of the earth.

A second assembly located on and between both of each first threaded stake and its associated second threaded stake is used to temporarily join these stakes at a region above the surface of the earth. The collective action of the collective second assemblies collectively serves to directionally align the temporarily suspended foundation form to the surface of the earth.

Finally, a pourable construction material is poured into the foundation form so held and supported and so directionally aligned in order to make a slab on grade foundation.

4. A Device for Connecting a Construction Form to Stakes

In still another of its aspects the threaded construction stakes of the present invention are interactive with a device serving to connect the stakes to a substantially horizontal elongate construction form having an elongate planar face and an opposite elongate "C"-channel with lips.

The device includes a clip element in the substantial form of bent plane having a length and a cross section, orthogonal to an axis of the length, that is topologically equivalent to a "U" with a substantially central trough and two flanges. Each of the two flanges has at its furthest extent a feature that is complimentary to fit within, and to engage, the "C"-channel of the construction form. The clip element is slightly rotated in an imaginary horizontal axis so that the two flanges of its trough engage the "C"-channel of the construction form. When so engaged the clip element extends across the width of the "C"-channel, and the construction form of which the "C"-channel is a part.

A first nut screws upon the threaded stake. This nut has an external diameter smaller than the trough of the clip element. It may thus be semi-permanently left mounted upon the threaded stake, including during insertion of the threaded stake into and through the "U"-channel of the clip element.

A first, bar, element having an open-ended channel is side slipped over the threaded stake. The channel of this first bar element is larger than the diameter of the threaded stake but smaller than the external diameter of the first nut.

According to this arrangement, the first nut abutting the first bar element abutting a first end of the clip element's trough serves to locate and position this trough, and the clip element, along the substantially vertical threaded stake.

A second nut also screws upon the threaded stake. This nut again has an external diameter smaller than the trough of the clip element.

A second, connective, element having an open-ended channel again side slips over the threaded stake. The channel of this second bar element is larger than the diameter of the threaded stake but smaller than the external diameter of the second nut. The second nut abuts the second bar element which abuts a second end of the clip element's trough, serving to locate and position this trough, and the clip element, along the substantially vertical threaded stake in a position between the first nut/first bar element and the second nut/second bar element. The first and the second nuts can already be affixed to the threaded rod when the clip element is positioned about the threaded rod or, conversely, the clip element may be positioned about the threaded rod while the first and the second nuts are already affixed.

By this arrangement, the first, bar, element and the second, connective, element can both be side slipped about the threaded rod even when the clip element is already positioned about the threaded rod, and even when the first and the second nuts are already screwed upon the threaded rod.

Collectively in sequence, the clip element is first rotated into position, the threaded stake is then rotationally driven into the ground, then each of the first and the second nuts is screwed into position, and then each of the first and the second bar elements is slipped into position, so as to engage the threaded rod to the construction form.

These and other aspects and attributes of the present invention will become increasingly clear upon reference to the following drawings and accompanying specification.

DESCRIPTION OF THE PREFERRED EMBODIMENT

Figure 1:
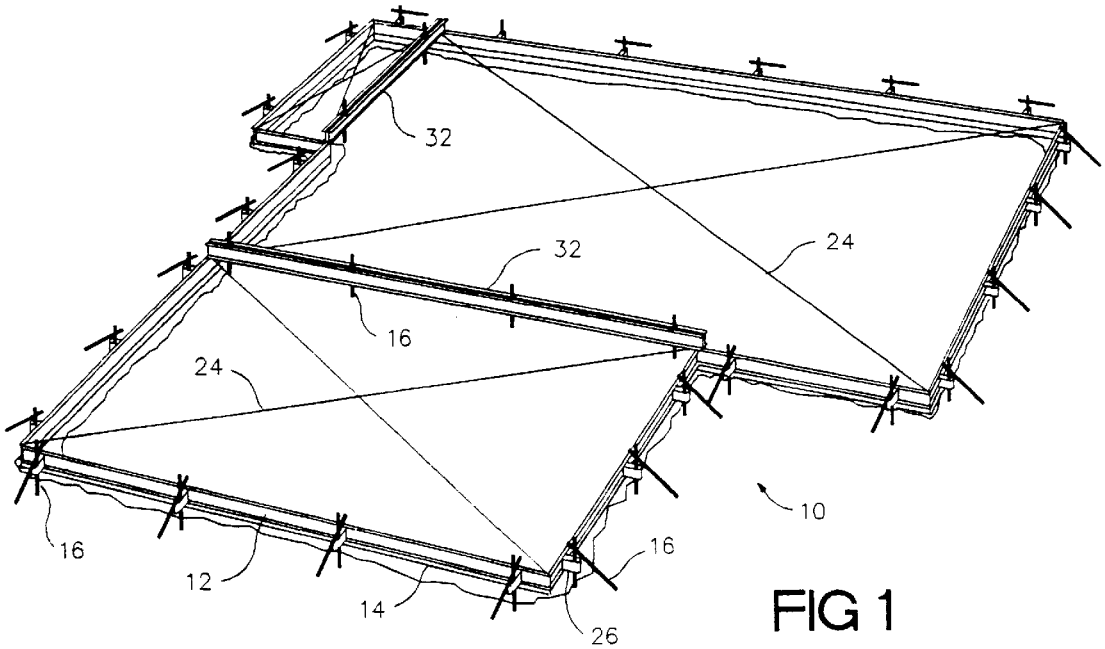
FIG. 1 shows a form, supported level and true above the surface of the earth by the threaded stakes of the present invention, set up for forming a monolithic slab on grade.

In the following description, the following reference numerals in the drawings will be noted to correspond with the following elements:

10 Monolithic forming unit
12 Form member
14 Form skirt
16 Threaded stake with a second, top, end feature (namely, a hexagon)
16' Threaded stake with full length threads
18 Nut, coarse thread
18' Nut, coarse thread as used to drive the stake 16'
20 Hairpin bar
22 Kicker plate
24 Squaring wire
26 Slab clip
28 Clip flange
30 Extended edge
32 Overhead screed
34 Track section
36 Spacer block
38 Pin, with tapered tip
40 Connecting ring
42 Rivet, or equivalent
44 Clamping device
46 Corner
48 Folded body
50 Corner plate Commencing in drawings FIG. 1, a monolithic forming unit 10 is shown prior to placement of in-situ concrete for a slab-on-grade foundation. Foundation trenching is omitted for clarity. Forming unit 10 is made up of, and has geometry determined by, a plurality of components: a form member 12, an overhead screed 32, and a squaring wire 24. Specific lengths and relative positions of these linear elements define a required unique geometry of forming unit 10, for a given particular slab-on-grade foundation design. Permanent treatment of element surfaces to prevent adhesion of concrete, by use of compounds such as epoxy paint and hard wax, is beneficial to utility of unit 10, but is not necessary.

Each length of form 12 is most economically of a cold-rolled steel "C" section, such as would be used for a joist. This member may also be of another metal such as aluminum, or of plastic, and may be formed in any manner. The preferred cold-rolled joist type section may vary considerably in size and weight. A 200 mm (8") or 150 mm (6") deep member with 63 mm (2½") flanges of 1.5 mm (16 gage) steel is one appropriate section to use. If lighter weight is desired, 1.15 mm (18 gage) steel may be used with some loss of span capacity and durability. If light weight is very important for such things as relocating forming unit 10 intact, equivalent strength aluminum may be used at greater expense. In any case, it is important that the member be stiff enough to maintain accuracy (i.e., straightness) between intersecting geometry-defining members. If foundation particulars require, an optional skirt 14 may be attached below form 12, or depth of form 12 may be 250 mm (10") or greater to suit.

Support of forming unit 10 is by a number of a threaded stake 16 which screws directly into the ground. Connection of threaded stake 16 with any form 12 is via a slab clip 26. Support may be given to screed 32 directly with threaded stake 16. More specifics of these parts and methods are described below.

Figure 2:
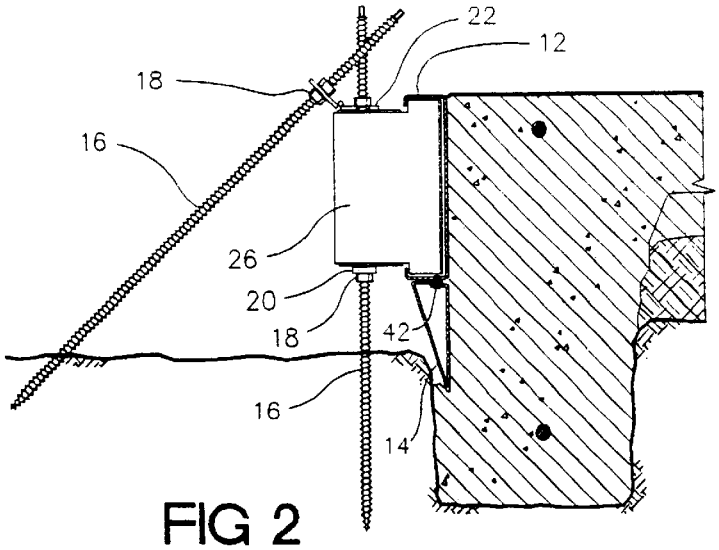
FIG. 2 shows a section view of a perimeter form where the threaded stakes in accordance with the present invention may also be viewed.

Continuing in drawings FIG. 2, a section view of form 12 after the placement of concrete shows one example of foundation perimeter construction. Many aspects of this construction detail may change to suit particular project circumstances. The top of form 12 defines the top surface of a concrete slab. Optional form skirt 14 is employed here to allow perimeter concrete vertical surface to be formed within and near a trench edge.

Figure 5:
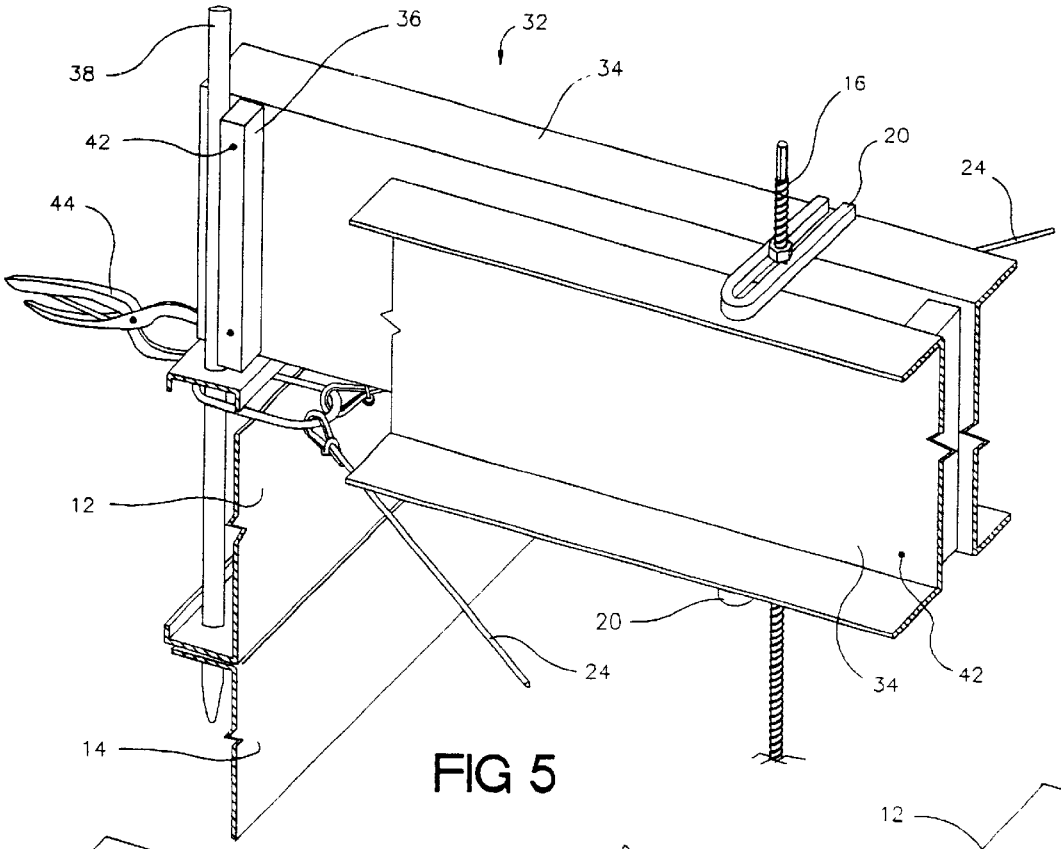
FIG. 5 shows overhead screed to perimeter form connection.
Figure 6:
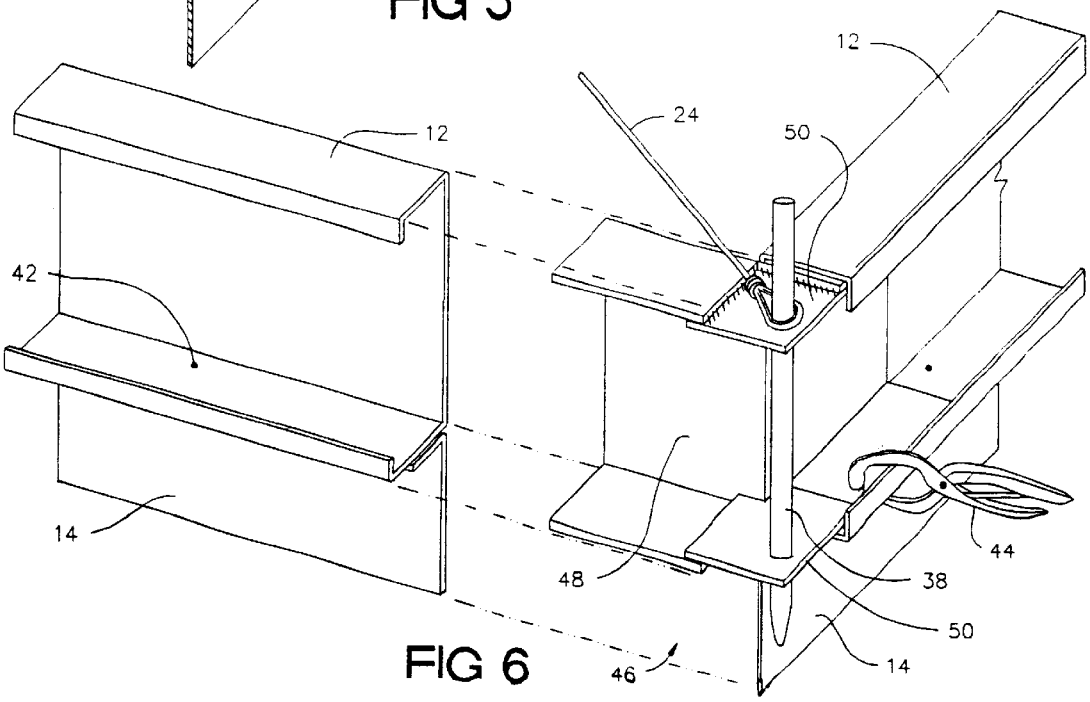
FIG. 6 shows a perimeter form corner.

The triangular shape of skirt 14 allows it to better sustain the cantilever loading from concrete forming and be made of lighter gage metal than the simple "L" section skirt 14' (of FIGS. 5 & 6). The triangular section also provides a tapered lower end, thus allowing easier removal from hardened concrete that has flowed around to the outside. The dimensions of skirt 14 may vary to suit construction needs. The maximum depth is really controlled by the strength of the total support of form 12 rather than the skirt itself. For most slab on grade situations, a depth of about 100 mm (4") is appropriate. The width at the top is about 38 mm (1.5"), but may vary considerably. A skirt of 0.848 mm (20 gage) steel material works fine, and an equivalent strength aluminum would be lighter weight. The interior may preferably be filled with an expanding adhesive type foam to give more surface support, and keep concrete, et cetera, out, and to improve durability of lighter gage metal. If skirt 14 is utilized, attachment to form 12 is with a number of a flush head rivet 42, or equivalent, as required.

Support to form 12 is provided by slab clip 26, which is fitted to the inside of form 12 "C" section. Clip 26 is supported by one, or most often two, of threaded stake 16. Stake 16, in conjunction with two of a nut 18, effectively clamps onto clip 26, thereby providing support.

Figure 2A:
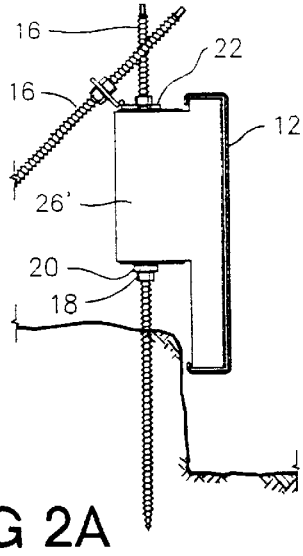
FIG. 2A shows a section view of the perimeter form without an optional skirt.

Continuing in drawings FIG. 2A, an identical view as FIG. 2, but before concrete placement, is shown. FIG. 2A show use of form 12 without any type of skirt below. Because form 12 is a readily available, standardized, low-cost joist section, there is motivation to use it alone, and avoid the fabrication and attachment of skirt 14. For this use, form 12 would be as deep as required for vertical surface forming. This could be 200 mm (8"), 250 mm (10"), or 300 mm (12"), or to suit.

With this use of form 12, a modified slab clip 26' (Regular slab clip 26 is described in detail below.) would best have a deeper extension of lower elements which keep between face back-side and lower flange lip of form 12. This slab clip 26' could be described as having an offset body. This offset allows clearance between grade and slab clip 26' body, et cetera, when form 12 is set partially into a trench.

For most contemporary post-tension slab-on-grade construction, trenches are not utilized, and so geometry of regular slab clip 26 (FIG. 2) is suitable. However, a foundation contractor may have to alternate between either conventional or post-tension slab-on-grade construction, as contracts require. So, if skirt 14 is not desired, a modified slab 26' clip which suits either type of foundation construction is appropriate.

Figure 3:
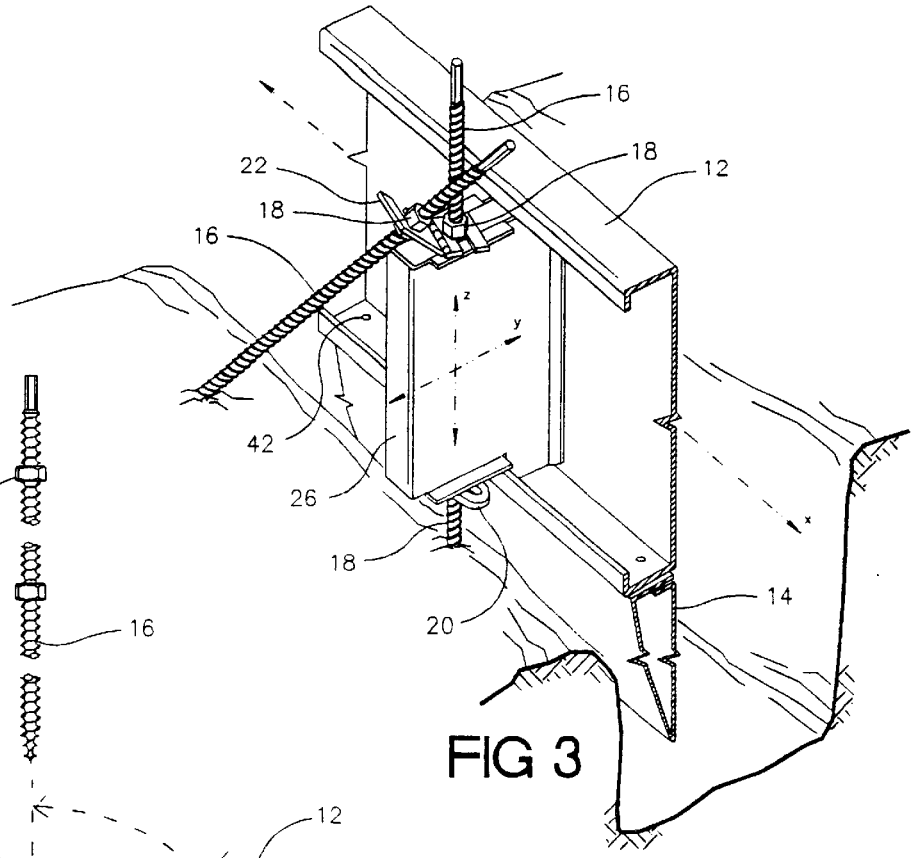
FIG. 3 shows form support components.

Continuing in drawings FIG. 3, the illustrated slab clip 26 is of folded sheet metal. A thickness of 1.81 mm (14 gage) steel is of adequate strength for prototypes, 2.58 mm (12 gage) is better for long term durability. Modified slab clip 26' (FIG. 2A) is better of 2.58 mm (12 gage) if its lower extensions are significant. The main body of clip 26 must easily allow the passage of stake 16 with nut 18. This is about 32 mm (1¼") clearance between wall elements in order to allow use of a 12 mm (½") diameter heavy hex body nut 18. Additional distance between sides of clip 26 can cause unwanted flexure of other connecting elements, and so should be avoided. The width of clip 26 must be enough to allow some adjustment of stake 16 location perpendicular to form 12 axis. This dimension may vary according to project requirements and form 12 section size, but a width of 125 mm (5") covers most applications. The height for clip 26 is that corresponding to form 12 section size, with a nominal dimension of about 150 mm (6") being a minimum practical height. Clip 26 has stiffening flanges at contact surfaces with support elements and with form 12 inside face. Top and bottom vertical extensions are sized to fit the inside of form 12 "C" section, providing slight clearance between form face back-side and flange stiffening lip, and between form top and bottom flanges.

Connection of clip 26 to stake 16 is made by the clamping pressure of a mutually opposed pair of nut 18. Nut bears against either a hairpin bar 20, or a kicker plate 22. Either of these elements serve to spread nut clamping force to both stiffened edges of clip 26 at opening for stake, and provide adequate friction at those edges to secure form 12 against in-situ concrete fluid pressure, et cetera.

Hairpin bar 20 is of either 9 mm (⅜") or 12 mm (½") square steel bar stock. It may be cold bent, and should be done so accurately about stake 16 diameter, so that the use of a washer is not required at nut 18. The finish length is unimportant, providing it spans the thickness of clip 26. The preferred length may be actually controlled by other embodiments of hairpin 20 not disclosed herein.

Kicker plate 22 is a steel hinge of heavy stock having a notch in each leg for purposes of insertion over threaded stake 16. Other embodiments of this device have been disclosed in FIG. 4 of U.S. Pat. No. 5,564,235 to the selfsame inventor of the present invention. For this embodiment of kicker 22, the use of heavier hinge stock is structurally important due to the required amount of clamping force applied via nut 18, combined with the span across side walls of clip 26. Alternatively, the kicker 22 can be of normal weight hinge stock, with the leg that spans slab clip 26 reinforced with an attached hairpin 20.

Figure 4:
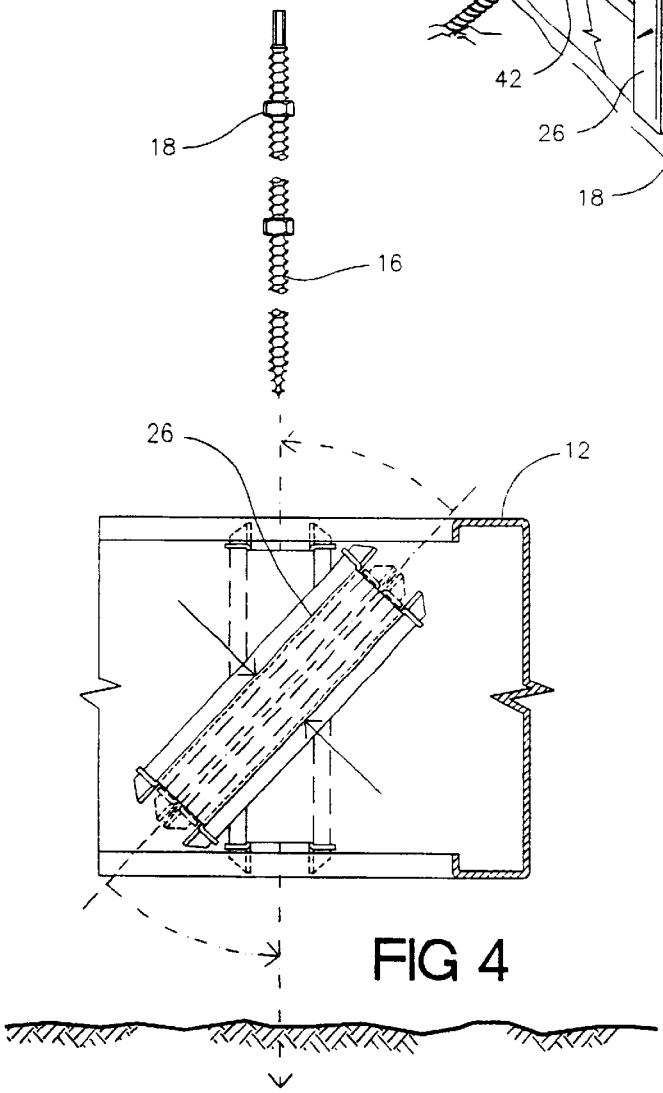
FIG. 4 shows threaded stake and slab clip interaction.

Continuing in drawings FIG. 4, the threaded stake 16 is of coarsely threaded rod material having a tapered-thread tip and a hex head, as disclosed previously for other embodiments. For an embodiment disclosed herein, where forms are lighter and stake 16 supports in-situ concrete fluid pressures directly, the parameters of successful design become more limited, so further discussion is warranted.

For threaded stake 16, the cut and pitch of the threads should be exaggerated over that of machine threads. Commercially available coil rod or lag bolt thread performs well in 12 mm (½") diameter, where the root diameter to outside diameter ratio is approximately 0.80 to 0.75. For larger diameters, this ratio becomes too large, and the threads must push relatively too much shank through the earth, and so may tend to strip rather than grab. If larger diameters are required, a specially manufactured thread would be preferable. A thread incline at the major diameter of at least 1 in 20, normally about 1 in 10, and more precisely 1 in 9.4 is appropriate for both the (i) soil and (ii) mechanical (i.e., nut) simultaneously made by the threaded stake 16.

The most economical commercially available stock material for threaded stakes 16 is coil rod. It is manufactured in 3.66 m (12') lengths and comes with loose cut coil-thread nuts designed to function even with debris and cement residue on the coil rod. Threaded stake lengths can be those suiting project requirements. Anything from about 0.45 m (½') up to 1.8 m (6') can be practical depending upon soil conditions and forming requirements. The 12 mm (½") diameter coil rod which has 4.23 mm per thread (6 threads per inch) is the best coil rod size for functioning in common mixed soils. The lead end is preferably tapered to a point over at least a 18 mm (¾") length, with the taper generally (i) being contiguous and continuous to, and/or (ii) having approximately the same thread pitch, as do the rest of the rod's threads. The portion of stake driven into earth can be roughly 0.15 m to 0.6 m (six inches to two feet), depending upon soil firmness.

In one, less preferred, embodiment a 9 mm (⅜") hex head is typically machined or forged onto the same rod stock, while still allowing nuts to pass and thread on from the head end of the stake. Machining the preferred hexagonal head affords more latitude in head size because the thread cut may run through the hexagonal cut, permitting nuts to thread onto, as opposed to slip over, the head. According to this possible construction, the diameter of the head is spoken of as only be "effectively" smaller than is the root diameter of the threaded regions. A deep head of at least 25.4 mm (one inch) in length, fitting a deep socket, provides more durability for stakes of mild steel material. Coil rod is available in harder steel, but the extra expense has not proven to be necessary.

In a most preferred embodiment the threads of the stake are continued all the way to its above-earth proximal end, and the stake threads two typically 12 millimeter (½"), typically hex head, nuts. The nuts have a thread matching that of the stake and thread onto the stake individually in sequence from the head end of the stake until, at a convenient location along the stake which is commonly near to its proximal end, the two nuts are jammed together, becoming semi-permanently locked together in position upon the stake.

Figure 4A:
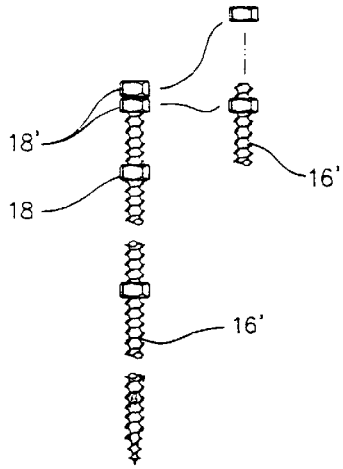
FIG. 4A shows a threaded stake without a hex head that threads nuts.

Continuing in FIG. 4A, a threaded stake 16' is shown. The top end of this stake has a simple cut end, which can be de-burred as a minimum precaution to avoid hand cuts, et cetera.

A hex nut 18' can be identical to nut 18, typically having a finished hex nut body as would normally be utilized for coil rod hex nuts, the sole difference being that a pair of nuts 18' is utilized as a driving means for stake 16', Overall geometry of each nut 18' is such that when each of a pair is tightened against the other, the facets of each nut align. These aligned facets serve as a hex driving head which is able to strong impart rotational force into stake 16'. Thus a pair of nuts 18' become locked onto the very top of stake 16', creating a driving head, without the need of fashioning a driving head onto the stake itself.

In a specific example, the geometry for each of the pair of hex nuts 18' is typical of manufacture for hex nuts corresponding to 12.5 mm (½") diameter coil, where the hex nut body is nominally of 22.2 mm diameter across the flats, and is given an industry standard thread over-cut relative to coil rod thread. For this example the stake 16' is of typical coil rod having an incline and hardness typical for 12.5 mm (½") diameter mild-steel coil rod (as described above). Given these materials, the coaction is such that, as each nut 18' is tightened rotationally toward the other by a moment force of very approximately 75 Newton meters (55 ft*lb), then the corresponding hex nut facets do not quite reach becoming mutually planar, at least to the extent that a typical deep socket drive tool of the proper nominal size can simply be inserted over both nuts. At a greater torque, when the facets do just exactly become mutually planar, a point is reached where a 12.5 mm diameter mild steel coil rod will be stressed nearly to the material yield threshold.

Thus the "vertical" dimension of each nut 18', in the direction of the longitudinal axis of the stake 16', is such that both nut facets align as described above at the proper amount of mutual moment force between the nuts. This relevant dimension is, of course, the contact surfaces of the nuts relative to the thread helix inside of each nut. It is, of course, most convenient when all driving nuts 18' are identical, making that the vertical dimension of each nut corresponds to a whole number of helical rotations when the nuts are mutually tightened at a maximum desired amount.

The resulting amount of frictionally-preserved mutually-opposing force onto threads of stake 16' must be enough to couple a pair of nuts 18' to the stake 16' for purposes of screwing the stake into and out of the earth soil for various soils and various circumstances of desired use. This is attainable in the example above, and is therefore attainable for all larger diameters of coil rod, given that the coil thread incline is proportionately less for larger diameters of the same manufacture, and that the incline is the most critical factor in a locking nut driving couple. That is, too steep an incline will make that the required couple will not be attainable. The 1:9.4 incline of 12.5 mm diameter coil rod is best not exceeded.

The preferred embodiment stake 16' avoids the manufacturing cost of machining or forging the hex head onto stake 16. The double-hex nut driving head has a safety advantage in presenting a relatively broad, smooth, and rounded surface at the top of stake 16'. Plastic safety caps—such as those commonly utilized to protect exposed ends of steel reinforcing bar and construction stakes —need not be required for stake 16'.

Because the locked pair of nut 18' can subsequently be rotated away from each other, access can be had to the middle or upper portion of the stake threads for additional nuts, without necessarily starting the additional nuts from the lower end of stake 16'. Hex nuts 18' utilized as the driving head can be identical to other hex nuts 18 present on stake for attachment purposes, and so are interchangeable. New nuts can serve as the driving pair.

As another alternative, a single nut 18', or an equivalent driving head of any shape, can simply be welded onto the upper end of any threaded stake. This can be done by any number of methods known to those in the steel fabrication trades and manufacturing. This arrangement of a driving head does require that all nuts subsequently installed onto the stake be started at the lower end, of course.

Considering the stakes 18, 18', a specially made, more exaggerated, thread could be better grabbing than is the thread of standard coil rod for a given embedded stake length in certain types of earth. The pitch of coil thread cannot be exceeded because of the mechanical requirements of connections to slab clip 26, et cetera, using those same threads. Thus far, the expense of a custom made thread has not proven justifiable. Threaded stakes made from industry standard coil rod perform surprisingly well.

Continuing in drawings FIG. 5, a view of perimeter form 12 at a location where it intersects with overhead screed 32 is shown. This location is also where those same controlled-length linear elements meet specifically to create horizontal foundation geometry. To serve this purpose, form 12 and screed 32 function as compression strut elements, in conjunction with a pair of squaring wire 24 which maintain tension reactions for any rectangle of strut elements. All of these members are arranged to provide a two-dimensional statically-determinate structure. The length and fabrication of these members, including attachment of fixtures for placing foundation hardware, can be numerical control. Specific software for this purpose is appropriate, even if it is utilized solely for manual layout dimensions. Screed 32 may also be redundant to, or independent of, elements statically determining foundation geometry.

Squaring wire 24 may be adjusted to be taut when foundation geometry is correct. Wire clamps at connecting thimbles is the simplest device for this adjustment. Where multiple wires 24 tie into a single point, a connecting ring 40 is employed. Ring 40 requires only a minimal access slot to be made through form 12 surface, while providing simple connection to the outside of form 12. Ring 40 may be an adjustable u-bolt or the like, in lieu of the closed ring depicted.

A pin 38 is a 18 mm (¾") diameter steel rod, or the like, with a tapered lower end. The exact specification in unimportant. It may be identical to rods now conventionally used as form stakes. It provides mutual connection for horizontal linear elements at a point of intersection. A clamping device 44, such as a large opening locking plier normally used for holding pieces to be welded, which plier is trademarked as the "Vice Grip®" locking plier ("Vice Grip®" is registered trademark of Peterson Manufacturing Company), provides any necessary connection, vertically.

Overhead screed 32 is of two of a track section 34 connected at regular intervals with a spacer block 36. Each track section is that manufactured of cold-rolled steel for use in light-gage metal framing. A thickness of 1.44 mm (16 gage) steel is appropriate material for most screed 32 applications, but equivalent strength aluminum could be used to save weight. The flanges should be about 38 mm (1⅜"), and the height should be 150 mm (6") or 200 mm (8"), but these dimensions may vary considerably. Spacer blocks 36 are attached every 1.2 m (4') or so. They are of any material such as plastic, and attach with a plurality of a rivet type fastener 42, or the like. The terminal block is placed specifically to have screed 32 create the right foundation geometry when bearing against pin 38.

Note that overhead screed 32 depicted, may be replaced by a conventional screed placed within the plane of the slab, such as one of the existing products which then remain in place as control joints. The same role as a strut element in defining foundation geometry would apply to this type of screed member, if required.

Finally in FIG. 6, a corner 46 is shown with one form 12 on, and one form 12 off. Corner 46 is of 4.7 mm (3/16") steel or the like. It has a folded body 48 which is first bent into a channel section, then with flanges cut, is bent to the angle of the corner, usually 90 degrees. A corner plate 50 is welded on, top and bottom, for rigidity, and for locating pin 38. Corner 46 may be made for any angle. It is of mitered joint construction for body 48 flanges, in lieu of corner plates 50, for reverse angles.

Skirt 14 shown here is of the simple "L" shape. If it is employed, it is fastened on with a series of a flush-head rivet type fastener 42. Alternatively, it may be clamped in place with conventional clamping devices, such as those trade marked as "Vice Grip". It then may be of members having varied depths to suit site grade requirements, for projects not having a perfectly flat, graded pad.

In preparation of the forms system of the present invention as shown in FIG. 1, the foundation construction does not require the usual time consuming set up and squaring of layout strings, because monolithic forming unit 10 is internally collocating. Lower accuracy layout for foundation trenches may be performed with a triangulated layout diagram which references all foundation turning points off of two reference points. Ideally, any software which defines fabrication of all members of unit 10, would also provide this trench layout diagram. Most contemporary post tension slab on grade construction utilizes no trenches, so there is no need for any trenching layout. This method then provides added benefit, because with it, layout never has to be performed at all. Internally collocating unit 10 is simply set at an appropriate location, and is then used directly as a reference for plumbing, et cetera.

All of the foundation geometry defining members, such as forms 12, screeds 32, and squaring wires 24, may be assembled on the ground to create forming unit 10. It is then moved or adjusted into place, and supported with stakes 16 and slab clips 26. Final adjustment in any direction or rotation may occur after slab clip 26 supports are in place. Stake 16 supports at screed 32 should be set subsequent to making unit 10 location adjustments, because they may offer some unwanted resistance. Sliding connections at slab clips are secured when unit 10 location is approved.

Alternatively, these geometry defining members can be assembled while each is supported by one or two stakes 16 and one slab clip 26, near each end. For this method, stakes 16 are generally set with trench edges as a location reference. Lower nut 18 is then preset to a determined elevation. Thus, all forms 12 are initially set approximately at the right location individually. Slab clip 26 connections typically provide enough adjustment to still support forms 12 after adjustment into exact location as unit 10, without removal and replacement of stakes. As forms 12, screeds 32, and squaring wires 24 are interconnected, internal collocation of unit 10 occurs, while it is floating on supports.

All forms 12, screeds 32, and wires 24 have mirror-identical connections at either end, thus the assembly of unit 10 may be accomplished to suit a mirrored version of any particular foundation design, by switching the members corresponding to each end of a given member. original vertical orientation of all members may be maintained.

Squaring wires 24 can be removed anytime after forms 12 making up unit 10 have been secured into position at slab clips 26, as described below. Wires 24 have performed their function of geometry definition, and so removal may be undertaken before placement of concrete. Alternatively, wires 24 may be left in place for redundant definition of geometry during the period of concrete placement, when loads to forms 12 are highest and least predictable. Wires would then be removed immediately after concrete is placed and screeded off flush, and before any other surface finishing is performed on the concrete. For those preferring some other method of squaring forms, use of wires 24 is optional.

Continuing in FIGS. 2 & 2A, the perimeter section view therein of a monolithic concrete pour illustrates basic structural support of form 12 against fluid concrete pressure. Vertical stake 16 accepts vertical and some horizontal forces, while sloped stake 16 provides buttress support for horizontal forces. Attachment to slab clip 26 is by mutual tightening of opposing nuts 18 on vertical stake. Form 12 is thus provided with all necessary support to allow a light-gage steel member to be utilized for foundation forming purposes. Removal of form 12, and skirt 14 if utilized, may occur anytime after solidification of concrete. Taper of skirt 14 assists removal when concrete has flowed outside the bottom edge, and hardened.

Continuing in FIG. 3, the view of the form 12 support shown therein reveals mechanical attributes of support components. In particular, the ease of adjustment to form 12 or unit 10, in any direction, at any time after support stakes 16 are set is illustrated.

Vertical stake 16 may be left with upper nut 18 loose while sloped stake has its corresponding nuts tightened about kicker plate 22. Thus, a stable, triangulated-support structure is created, while allowing form 12 or unit 10 to be slid horizontally along the y axis of slab clip 26 indicated. Adjustment along the horizontal x axis occurs by passing form 12, along its major axis, over slab clip 26. This movement is controlled by placement of, and connection to, a perpendicular form 12, which has its own slab clip 26 adjustable support. Horizontal rotation of entire unit 10 is possible with all stakes in place, because with vertical stake 16 upper nuts 18 loosened, movement in any horizontal direction is possible at all stake locations simultaneously.

Vertical adjustment is achieved separately of horizontal. The best procedure is to set the lower nuts to proper elevation with a preferred leveling device on vertical stakes before making any connections. Then, after all horizontal adjustments are performed, any required slight vertical adjustments are undertaken by adjustment of those nuts at the same time they are tightened against upper nuts. Considerable vertical adjustment requires loosening and adjustment of sloped stake nuts about kicker plate 22 simultaneously with adjustment of nuts on vertical stake.

Continuing in FIG. 4, an assemblage of stake 16 and slab clip 26 support to form 12 is illustrated. In the general case, slab clip 26 is secured to form 12 before stake 16 is employed.

Slab clip 26 may slide in from an end of form 12, but typically is inserted into form at any point from behind. Clip 26 is rotated into place in order to clear form stiffening lips. It is simultaneously squeezed to clear between form 12 upper and lower flanges as it is rotated to the perpendicular of form 12. As clip 26 springs back to its usual geometry, it remains secured to form 12 while being free to slide along the form length. Any number of clips 26 may be left on form 12 as it is taken from project to project. Stake 16 is then threaded into the earth through slab clip 26. Note that clip 26 does not need to be entirely vertical to function, allowing some latitude for driving stake 16. The preferred means of driving it is a pneumatic impact wrench of having a variable speed up to at least 6000 RPM and having a rated torque of at least 271 N*m (200 ft*lb).

Continuing in FIG. 5, the illustrated assembly of members making up monolithic forming unit 10 is easy. Connecting ring 40 passes through slot in face of form 12, and is initially barely pinned by the lower tapered end of pin 38. Overhead screed 32 is set into place. Pin 38 is then manipulated down so that lower end inserts into hole in form 12 lower flange. Resulting lever action serves to tighten squaring wire 24. Pin 38 acts as stop for terminal spacer block 36, thereby utilizing screed 32 as a strut element defining foundation geometry. Direct support at screed 32 performed by stake 16 and hairpin bar 20, is generally made subsequent to support and adjustment of forms described above.

Lower flange of each track 34 making up overhead screed 32 is used as screed guiding surface, in the same manner as the top of form 12 is used in defining a top of a concrete slab. Screed 32 is removed almost immediately after placement and screeding off of concrete, and before any concrete finish work begins. If wires 24 have been left in place for concrete placement, then they can be removed simultaneously with screed 32.

In FIG. 6 the outside corner 46 of monolithic forming unit is connected by slipping form 12 end over folded body 48 of corner 46. Pin 38 acts as a lever tightener for wire 24 as lower end is brought toward, and into, the hole in lower corner plate 50. Optional clamping device 44 provides redundant connection, since squaring wire 24 keeps assemblage intact.

In the system of the invention as shown in all Figures, removal of pins 38 and wires 24 begins disassembly process. This may be occur before, or immediately after, concrete placement. Screeds can be removed at the time which best facilitates concrete slab surface finishing. Nuts 18 are minimally loosened to free hairpins 20 and kicker plates 22, which frees screeds and/or slab clips 26 and forms 12. In distinct contrast to conventional stakes, threaded stakes 16 remove quickly and easily.

Continuing in the drawings FIG. 4A, operation of stake 16' is of no significant difference from stake 16, except that double nut 18' driving head must be disengaged in order to pass any additional nuts onto stake from its top end. Each of the driving nuts can serve as connecting nuts along the middle region of stake 16', as new nuts can be threaded on and mutually locked to serve as driving nuts 18', in the case where identical nuts serve either purpose.

Most preferably, each of nuts 18' is mutually tightened in a location such that the uppermost surface of the upper locked nut roughly aligns with the upper end surface of stake 16'.

Should stake 16' become worn at the portion of its threads where a pair of nut 18' engage it from repeated use, then a portion of the top of stake can simply be cut off, and de-burred if necessary. A new portion of threads are now able to be engaged by a newly locked pair of nuts 18' at the top of the stake 16'.

While only the top one of the mutually locked pair of hex nuts 18' need be engaged as a driving head, it is sometimes necessary to engage the lower of the two nuts in order to rotate stake 16' in the direction required to remove it from the earth. For this reason it is strongly preferred that the facets of the pair of hex nuts 18' should nearly align, permitting that an ordinary deep socket driver can be engaged onto the lower of the two nuts. In this location the socket can engage either of the aligned nuts, depending upon rotation direction. In each case, it is the nut rotating in a direction which bears toward the other which must be engaged. For this reason, the nut pair cannot be in a locked position where the facets rotate beyond a mutually planar position. If this should be the case then the deep socket driver rotation will tend to loosen the nut pair in simply working on the nut which loosens the pair.

A summary of the ramifications and scope of the present invention is as follows. Although ubiquitous of general use in construction, the threaded stakes of the present invention are integral to a concrete slab forming system that completely eliminates the most prevalent difficulties in foundation construction. The system does not require complex, unwieldy supporting hardware, as previous attempts at providing form location adjustment have. The method utilizes elements having a cost equivalent to conventional boards and stakes, yet it provides sophistication which saves substantial amounts of labor and improves foundation quality. Benefit is considerable for one unit. Aggregate benefit is enormous for repeated identical and mirrored units. Because of the repeatable foundation accuracy, the use of increasingly popular light gage structure framing is expedited, particularly for 'panelized' construction. The method both simplifies, and optimizes the accuracy of, the foundation forming process.

The threaded stakes of the present invention are most suitable for positioning of construction components and the like. However, the solid yet fully adjustable clamping-action connection, utilizing the same threads which penetrate the earth, suits the positioning of many objects which are unrelated to building construction. This usage includes the support of temporary staging or working surfaces, temporary or permanent support of sign structures or barricades, and the accurate positioning of objects such as dish antennae, et cetera. The threaded stakes of the present invention provide far superior anchorage from uplift or buoyancy forces than do similar sized pound-in stakes, for either temporary or permanent supporting conditions.

The threaded stakes of the present invention can also be utilized simply as pinning elements, such as conventional pound-in stakes are. This use can be identical to how circus tent stakes are commonly utilized to pin tent cables, the major difference being that the pound-in type stakes are often very difficult to remove from the earth, and so are injurious to workers, whereas the threaded stakes of the present invention simply unscrew and thereby easily back out of the earth.

Although the description above contains many specifics, these should not be construed as limiting the scope of the intention, but merely as providing illustration of the preferred embodiments. For example, the threaded stake 16 and slab clip 26 method of form support provides utility independently of slab-on-grade construction. These components provide considerable benefit for free standing foundation walls, or sidewalk and curb construction, et cetera.

The threaded stake 16 of the present invention has already proven to provide enormously versatile utility in concrete forming, with almost limitless applications.

In accordance with the preceding explanation, variations and adaptations of the threaded construction stake in accordance with the present invention will suggest themselves to a practitioner of the construction equipments arts.

In accordance with these and other possible variations and adaptations of the present invention, the scope of the invention should be determined in accordance with the following claims, only, and not solely in accordance with that embodiment within which the invention has been taught.

I claim:

1. An elongate metal stake suitable to be screwed into the earth comprising:

an elongate metal body;

a first end region to the body tapered to a point suitable to be plunged into the earth;

at least a middle region to the body externally threaded with threads that are both deeply cut and steeply inclined so as to be suitable for screwing into the earth; and a second end region to the body having threads contiguous with the threads of the body's middle region, presenting at butt end a feature that is suitable to be engaged and to be rotated so as to turn all regions of the body by action of a torquing force applied to the feature, in combination with at least one pair of nuts that are (i) entered onto the threads of the body's second end region regardless of the second end region's butt end feature and (ii) advanced by turning first along the threads of the body's second end region and then along the contiguous threads of the body's middle region so as to, predetermining a position in the body's middle region, hold locked between the at least one pair of nuts an external member to the body's middle region, and thus to the body;

wherein the elongate metal body is suitably screwed into the earth, the first end region downward, as a stake by application of a torquing force to the butt end feature of the body's second end region; and wherein the at least one pair of nuts hold the external member to the body's middle region at the predetermined position on the elongate metal body which position is above a surface of the earth into which the body is screwed as the stake.

2. The elongate metal stake suitable to be screwed into the earth according to claim 1 wherein the butt end feature of the body's second end region comprises:

threads contiguous with the threads of the body's second end region and further with the threads of the body's middle region; in combination with at least a pair of nuts threading the threads of the body's second end region's butt end feature and locked together thereon so as to suitably be engaged and rotated at their outer surfaces by a torquing force in order to turn all regions of the body and screw it into the earth as the stake.

3. The elongate metal stake suitable to be screwed into the earth according to claim 2 wherein the pair of nuts threading the body's second end region have a linear extent relative to a thread helix inside of each nut so that, the linear dimension of each nut corresponds to a whole number of helical rotations when the nuts are mutually tightened upon the thread of the body's second end region to a maximum desired amount;

wherein the surfaces of the nuts align when the nuts are locked together.

4. A stake suitable for use in construction comprising:

an elongate threaded metal member with a bottom end and a top end having a length between 0.45 meter and 1.8 meter, a tapered first end region that is suitable to be plunged into earth, a second end region having a feature of polygonal shape in cross section that is suitable to be engaged and to be rotated, turning the entire elongate threaded metal member, by action of a torquing force; and an externally threaded middle region, the thread of the middle region being contiguous with the thread of the second end region, deeply cut, the threaded middle region having at a ratio of root diameter to outside diameter less than 0.80, and steeply inclined, the threads having an incline at the major diameter of at least 1 in 20; and at least one pair of nuts that are at a first time (i) entered onto the threads of the second end region over the second end region's feature and (ii) advanced by turning first along the threads of the second end region until (iii) temporarily locked together at the second end region, and then, at a second time, (iv) unlocked, and (v) further threaded along the contiguous threads of the middle region so as to, predetermining a position in the middle region, (vi) hold locked between the at least one pair of nuts an external member to the middle region, and thus to the elongate metal member;

wherein at the first time the elongate threaded metal member is suitably first screwed into the earth first end region downward to a variable extent by action of torquing the at least one pair of nuts that are locked together upon the second end region at the first time; and wherein at the second time, and after the elongate threaded metal member is so screwed into the earth, then the at least one pair of nuts that are then relocated to the member's middle region can be threaded along the threads of this middle region so as to hold the external member is held to the stake at a predetermined position above the surface of the earth;

wherein the same at least one pair of nuts that serve for screwing the stake into the earth at the first time also serve at the second time to hold the external member.

5. The stake according to claim 4 wherein the elongate threaded metal member's second end region comprises:

threads contiguous with the threads of the middle region, and extending to the first end region;

and wherein the second end region's feature comprises:

a plurality of nuts, at least at times separately used from at least one pair of nuts but identically the same as the nuts of the at least one pair, threading the threads of the second end region from the top end, the plurality of nuts locked together so as to present in cross section the polygonal shape;

wherein the locked plurality of nuts can be used first while locked in torquing the stake into the ground, and can then be unlocked and threaded further along the second region and into the middle region until two of the plurality of nuts being at a predetermined position serve to hold the external member locked between the nuts;

wherein the same nuts that are used in torquing the stake into the ground are also later used in holding the external member to the stake.

6. The stake according to claim 5 wherein the plurality of nuts threading the treads of the second end region from the top end are locked together in alignment, therein permitting that the rod may be rotated by torque applied to at least two of the locked plurality of nuts at the same time.

7. The stake according to claim 5 wherein each of the plurality of nuts threading the threads of the second end region's feature from the top end has a linear extent relative to its interior thread so that when a pair of the plurality of nuts are mutually jammed and tightened together upon the threads of the second end region's to a maximum desired amount then the surfaces of the nuts align while the nuts are locked together.

8. An elongate metal stake suitable to be screwed into the earth comprising:

an elongate metal body having a first end region tapered to a point suitable to be plunged into the earth, a middle region to the body externally threaded with threads suitable for screwing into the earth, the threads having at a ratio of root diameter to outside diameter less than 0.80, and an incline at the major diameter of at least 1 in 20, and a second end feature suitable to be externally engaged and torqued and rotated so as to screw the body into the earth as a stake by action of the threads upon the body's middle region when the body's first end region point is plunged into the earth; in combination with at least one pair of nuts threading of the body's middle region threads so as to, upon predetermining a position in the body's middle region above a level of the earth, hold locked between the at least one pair of nuts at this level an external member to the body's middle region, and thus to the body;

wherein the same middle region threads of the elongate metal body that permit that (i) the body should be screwed into the earth, the first end region downward, as the stake by application of a torquing force to the second end feature of the body also permit that the (ii) at least one pair of nuts should thread the same middle region threads, and should hold the external member to the body's middle region at the predetermined position on the elongate metal body and above the surface of the earth into which the body is screwed as the stake.

* * * * *